US009534514B2

(12) United States Patent
Bayrakdar et al.

(10) Patent No.: US 9,534,514 B2
(45) Date of Patent: Jan. 3, 2017

(54) CAMSHAFT ADJUSTING SYSTEM

(71) Applicant: Schaeffler Technologies AG & Co. KG, Herzogenaurach (DE)

(72) Inventors: Ali Bayrakdar, Roethenbach/Pegnitz (DE); Joachim Dietz, Frensdorf (DE); Gerhard Scheidig, Oberasbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 36 days.

(21) Appl. No.: 14/430,818

(22) PCT Filed: Sep. 9, 2013

(86) PCT No.: PCT/DE2013/200161
§ 371 (c)(1),
(2) Date: Mar. 24, 2015

(87) PCT Pub. No.: WO2014/094746
PCT Pub. Date: Jun. 26, 2014

(65) Prior Publication Data

US 2015/0267570 A1 Sep. 24, 2015

(30) Foreign Application Priority Data

Dec. 18, 2012 (DE) ..... 10 2012 223 582

(51) Int. Cl.
*F01L 1/34* (2006.01)
*F01L 1/344* (2006.01)
*F01L 13/00* (2006.01)

(52) U.S. Cl.
CPC .... *F01L 1/3442* (2013.01); *F01L 2001/34483* (2013.01); *F01L 2013/111* (2013.01)

(58) Field of Classification Search
CPC ..... F01L 1/3442; F01L 2001/34483; F01L 2013/111
(Continued)

(56) References Cited

U.S. PATENT DOCUMENTS 6,619,248 B1 9/2003 Bertelshofer et al.
8,931,448 B2 * 1/2015 Schelter ..... F01L 1/46 123/90.15

(Continued)

FOREIGN PATENT DOCUMENTS

DE 10161701 A1 6/2003
DE 102004035035 3/2005

(Continued)

*Primary Examiner* — Ching Chang
(74) *Attorney, Agent, or Firm* — Davidson, Davidson & Kappel, LLC

(57) ABSTRACT

A camshaft adjusting system (1) having a camshaft adjuster (2) and a camshaft (3), wherein the camshaft adjuster (2) has a drive element (4) and an output element (5) which is disposed so as to be pivotably movable with respect to the drive element (4), wherein the output element (5) is non-rotatably connected to the camshaft (3), wherein a cover element (6) is fastened non-rotatably to the output element (5) and the hub (9) of the cover element (6) is disposed between the output element (5) and the camshaft (3), wherein the radial direction of extension of the cover element (6) is greater than the diameter of the contact surface (10) of the hub (9) of the cover element (6) to the camshaft (3).

10 Claims, 4 Drawing Sheets

(58) Field of Classification Search
USPC ..... 123/90.15, 90.17
See application file for complete search history.

(56) References Cited

U.S. PATENT DOCUMENTS

| | | | |
|---|---|---|---|
| 2005/0056249 | A1 | 3/2005 | Heinze et al. |
| 2005/0066924 | A1 | 3/2005 | Lehmann et al. |
| 2005/0103294 | A1 | 5/2005 | Heinze et al. |
| 2008/0236529 | A1 | 10/2008 | Scheidig et al. |
| 2008/0264200 | A1 | 10/2008 | Hoppe et al. |
| 2010/0294387 | A1 | 11/2010 | Scheidig et al. |
| 2011/0120399 | A1 | 5/2011 | Weber |

FOREIGN PATENT DOCUMENTS

| | | | |
|---|---|---|---|
| DE | 10346443 | | 5/2005 |
| DE | 102005041393 | | 3/2007 |
| DE | 102008006179 | | 7/2009 |
| DE | 102009054049 | | 5/2011 |
| DE | 102011050084 | A1 | 11/2012 |
| WO | WO2005/049976 | | 6/2005 |
| WO | WO2010/066551 | | 6/2006 |
| WO | WO2007/068586 | | 6/2007 |

* cited by examiner

CAMSHAFT ADJUSTING SYSTEM

The present invention relates to a camshaft adjusting system.

BACKGROUND

Camshaft adjusters are used in internal combustion engines to vary the control times of the combustion chamber valves to be able to vary the phase relation between a crankshaft and a camshaft in a defined angle range between a maximum advance position and a maximum retard position. Adjusting the control times to the instantaneous load and rotational speed reduces consumption and emissions. For this purpose, camshaft adjusters are integrated into a drive train via which a torque is transferred from the crankshaft to the camshaft. This drive train may be designed, for example, as a belt, chain or gear drive.

In a hydraulic camshaft adjuster, the output element and the driving element form one or multiple pair(s) of counteracting pressure chambers to which a hydraulic medium is applied. The driving element and the output element are coaxially situated. A relative movement between the driving element and the output element is created by filling and emptying individual pressure chambers. The rotatively acting spring between the driving element and the output element pushes the driving element toward the output element in an advantageous direction. This advantageous direction may be in the same direction or in the opposite direction of the direction of rotation.

One design of the hydraulic camshaft adjuster is the vane-type adjuster. Vane-type adjusters include a stator, a rotor and a drive wheel which has an external toothing. The rotor as the output element is usually designed to be rotatably fixedly connectable to the camshaft. The driving element includes the stator and the drive wheel. The stator and the drive wheel are rotatably fixedly connected to each other or, alternatively, they are designed to form a single piece with each other. The rotor is situated coaxially with respect to the stator and inside the stator. Together with their radially extending vanes, the rotor and the stator form oppositely acting oil chambers to which oil pressure may be applied and which facilitate a relative rotation between the stator and the rotor. The vanes are either designed to form a single piece with the rotor or the stator or are situated as "plugged-in vanes" in grooves of the rotor or stator provided for this purpose. The vane-type adjusters furthermore have various sealing covers. The stator and the sealing covers are secured to each other with the aid of multiple screw connections.

Another design of the hydraulic camshaft adjuster is the axial piston adjuster. In this case, a shifting element, which creates a relative rotation between a driving element and an output element via inclined toothings, is axially shifted with the aid of oil pressure.

A further design of a camshaft adjuster is the electromechanical camshaft adjuster, which has a three-shaft gear set (for example, a planetary gear set). One of the shafts forms the driving element and a second shaft forms the output element. Rotation energy may be supplied to the system or removed from the system via the third shaft with the aid of an actuating device, for example an electric motor or a brake. A spring may be additionally situated, which supports or feeds back the relative rotation between the driving element and the output element.

SUMMARY OF THE INVENTION

It is an object of the present invention to provide a camshaft adjusting system which has a particularly simple and reliable construction.

A camshaft adjusting system is provided having a camshaft adjuster and a camshaft, the camshaft adjuster including an output element and a driving element which is situated so as to be pivotably movable with respect to the output element, the output element being rotatably fixedly connected to the camshaft, and, furthermore, a cover element being present, which is rotatably fixedly connected to the output element, and the hub of the cover element is situated between the output element and the camshaft, the radial direction of extension of the cover element being greater than the diameter of the contact surface of the hub of the cover element to the camshaft.

In this way it is achieved that the camshaft adjusting system requires particularly little installation space in the axial direction, and that the cover element is fastened rotatably fixedly and reliably by the fastening of the camshaft adjuster to the camshaft, preferably by a central screw.

The cover element extends in the radial direction beyond the diameter of the contact surface of its hub with the camshaft so that preferably the entire camshaft-facing front side of the camshaft adjuster is covered by the cover element.

In one embodiment of the present invention, the cover element is designed as a trigger wheel or as a spring cover. With the aid of the trigger wheel, the angle position of the camshaft connected rotatably fixedly with the trigger wheel, and thus of the output element, may be ascertained. The spring cover covers the coils of the spring in the axial direction. The spring braces the driving element against the output element in a circumferential direction and is either designed as a spring having an axially oriented coil body, or as a spring with a radially oriented coil body.

In one advantageous embodiment, the cover element covers a spring of the camshaft adjuster and has the intrinsic function of a trigger wheel. In this specific embodiment, the cover element extends in the radial direction from its hub to nearly across the entire camshaft adjuster and covers the spring with its front area facing away from the camshaft, the markings for the function of a trigger wheel, which may be detected by a sensor, being located at the outer lateral surface of the cover element. This outer lateral surface may be formed by an angled section of the cover element.

In one particularly preferred embodiment, the hub is provided with friction-increasing means. Such means may be coatings or structures which increase the coefficient of friction and thus enable a higher torque to be transmitted between the components.

Since the maximally transmittable torque is further increased by such means, the required pretension of the screw connection, which fixes the output element, the cover element, and the camshaft with one another rotatably fixedly, may be further reduced and thus the maximally transmittable torque may be adapted to the torque required for the torque transmission.

The reduction of the required pretension may be carried out, for example, by reducing the extension length of the central screw, whereby the screw connection in its entirety and as seen in the axial direction may be designed to be shorter, and installation space may be saved.

The central screw may include a cavity which may be provided for a central valve.

Friction-increasing coatings may include particles which increase the coefficient of friction of the contact surface of the hub of the cover element, which is in contact with the camshaft or with the output element. Advantageously, the entire cover element may be provided with the coating during manufacture, the effort compared to the targeted coating only for a targeted area, in particular only the hub, thereby being reducible. The friction-increasing coating may be carried out on the camshaft-facing front side of the hub and/or on the front side of the hub facing away from the camshaft or the entire cover element.

Friction-increasing structures may be introduced with the aid of embossing methods, laser methods or electro-erosive methods (ECM) at least in the area of the hub of the cover element. In this process, a structure having a certain pattern is incorporated on or into the surface, which then, being in contact with the camshaft or the output element, forms a form-fitting connection. The friction-increasing structure may be carried out on the camshaft-facing front side of the hub and/or on the front side of the hub facing away from the camshaft or the entire cover element. Preferably, the cover element is designed to be harder, in particular in the area of the friction-increasing structure, than the output element or the camshaft, so that the structure may dig into the corresponding other component. With the aid of different hardening processes, for example, carbonitriding, nitrocarburizing or nitriding, the structure, alternatively also the entire component, may be provided with a higher hardness than that of the output element or the camshaft.

The friction-increasing coating may, together with the friction-increasing structure, be provided on the cover element.

Furthermore, the friction-increasing coating may be provided on the contact surface of the cover element to the output element, and the friction-increasing structure may be provided on the contact surface of the cover element to the camshaft.

Alternatively, the friction-increasing coating may be provided on the contact surface of the cover element to the camshaft, and the friction-increasing structure may be provided on the contact surface of the cover element to the output element.

In one embodiment of the present invention, the cover element is completely covered with a friction-increasing layer.

Advantageously, the entire cover element may be provided with the coating during manufacture, the effort compared to the targeted coating for only a targeted area, in particular only the hub, thereby being reducible. The friction-increasing coating may be carried out on the camshaft-facing front side of the hub and/or on the front side of the hub facing away from the camshaft or the entire cover element.

In one preferred embodiment, the friction-increasing means is designed as a coating or as a topographic structure of the surface of the cover element. The coating may be applied on the cover element using a thermal spraying method, hard particles having been admixed to the carrier fluid. The particles may be formed from tungsten carbide or other ceramic materials. The topographic structure of the surface corresponds essentially to the friction-increasing structure described at the outset. Preferably, the cover element is harder, in particular in the area of the topographic structure of the surface, than the output element or the camshaft, so that the structure may dig into the corresponding other component. The topographic structure may have different geometric appearances, for example, concentric spheres, spirals, a pattern of punctiform elevations or parallel lines or rays which extend from one shared point, preferably a circle center.

Alternatively, a thin film which is provided with a friction-increasing coating may be situated between the cover element and the output element and/or between the cover element and the camshaft. The friction-increasing coating may be applied either on both sides or on one side of the film. The film may initially be captively situated with the aid of an adhesive at the individual part, such as the cover element, output element or camshaft, before the individual components are joined with one another.

In addition, multiple films having a friction-increasing coating may be provided in a combination of multiple films between the output element and the cover element or between the cover element and the camshaft.

In one additional embodiment of the invention, the contact surface of the cover element to the camshaft is provided with a higher roughness than the rest of the cover element. Via a rough machining of the contact surface of the cover element, this surface is roughened in such a way that an uneven topographic structure is formed. Advantageously, a careful machining is deliberately omitted and the surface quality held low so that a torsional strength according to the present invention is achieved for the connection with the peripheral component. In addition, at least the surface of the contact surface of the cover element may be provided with a higher hardness with the aid of a hardening process than the peripheral component, which makes contact with the cover element in a rotatably fixed manner.

The, if necessary, required additional hardening processes may alternatively be replaced by a targeted choice of material for the cover element, the material of the cover element already having a higher hardness in its unprocessed state than the peripheral component, which then makes contact with the cover element in a rotatably fixed manner.

In one embodiment of the present invention, the hub of the cover element is followed by a centering section, which centers the cover element with respect to the camshaft or to the output element. The wall of the hub extends in the axial direction and forms an outer lateral surface, in particular a cylindrical surface. Due to this lateral surface, the cover element is oriented coaxially with respect to the output element or to the camshaft. With a press fit of the lateral surface of the hub of the cover element and the output element or the camshaft, the cover element is captively joined to the output element or the camshaft.

Alternatively, the design of the lateral surface may have a shape other than a cylindrical shape, for example, of a square or the like, which then, in addition to a coaxial orientation with respect to the output element or the camshaft, has a predefined angle position between the cover element and the output element or the camshaft. This is in particular advantageous in the embodiment of the cover element with a trigger wheel function, since then a defined angle position is achieved between the output element or the camshaft and the cover element with the aid of the shaping of the lateral surface. In a special case, the lateral surface is unique in its shape so that only one single angle position is possible between output element or camshaft and cover element.

In one advantageous embodiment, a camshaft adjuster of a camshaft adjusting system having a cover element is provided according to the present invention. Advantageously, the camshaft adjuster may already have an installed cover element before the camshaft adjuster is joined with the camshaft.

In one advantageous embodiment, a cover element of a camshaft adjusting system is also provided according to the present invention With an arrangement according to the present invention, an extremely rotatably fixed connection which reduces installation space is achieved between the camshaft adjuster and the camshaft.

BRIEF DESCRIPTION OF THE DRAWINGS

Exemplary embodiments of the present invention are illustrated in the figures.

DETAILED DESCRIPTION

Figure 1A:
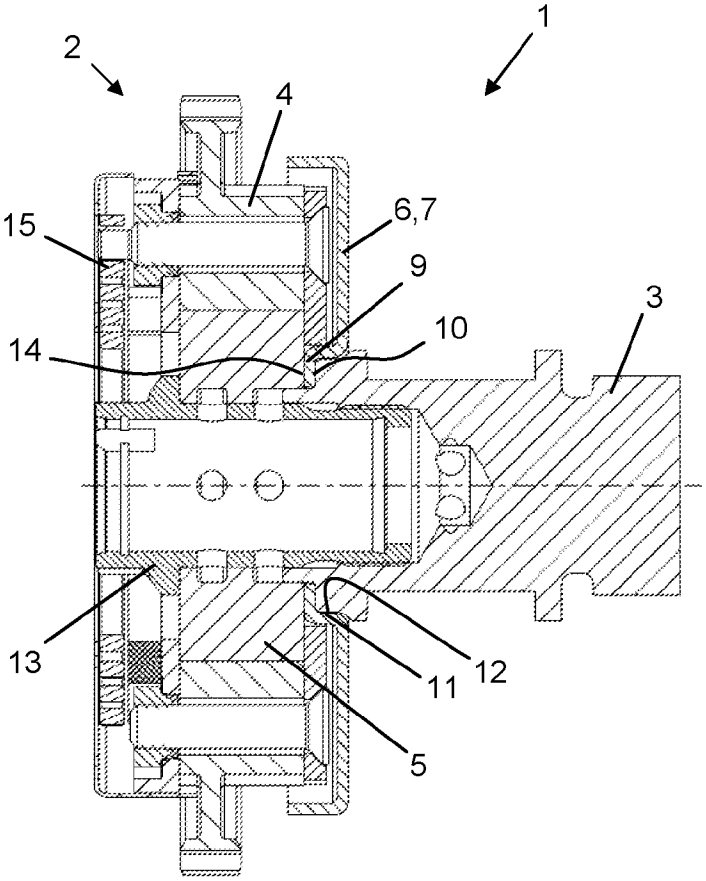
FIG. 1*a* shows a camshaft adjusting system having a camshaft adjuster and a camshaft, and a cover element designed as a trigger wheel.

FIG. 1*a* shows a camshaft adjusting system 1 having a camshaft adjuster 2 and a camshaft 3 and a cover element 6 designed as a trigger wheel 7.

Camshaft adjuster 2 is mounted with the aid of a coaxially positioned central screw 13 to camshaft 3 and thus forms camshaft adjusting system 1. In particular output element 5 designed as a rotor is rotatably fixedly connected to trigger wheel 7 and camshaft 3 by central screw 13. According to the present invention, trigger wheel 7 is clamped with its hub 9 between output element 5 and camshaft 3. In this configuration, the circular contact surface 10, which is formed on the side of hub 9 facing away from the rotor, makes contact with camshaft 3. The circular contact surface 14, which is situated on the side of hub 9 facing away from the camshaft, makes contact with output element 5. At least one of contact surfaces 10 or 14 is provided with friction-increasing means, such as a friction-increasing layer or a friction-increasing structure or a film element having a friction-increasing layer or structure. In this way, a higher torque may be transmitted in the screw connection, or the screw force for the transmission of the required torque may be reduced.

Spring 15, which braces driving element 4 to output element 5 in the circumferential direction, is situated on the side of camshaft adjuster 2 facing away from the camshaft.

Trigger wheel 7 has a centering section 11 which sits or may sit on camshaft 3 with its lateral surface 12. Via this centering section 11, camshaft adjuster 2 may be centered with respect to camshaft 3, i.e., oriented coaxially toward one another.

With its radial extension, trigger wheel 7 covers nearly the entire camshaft adjuster 2. At the radially outermost area of trigger wheel 7, trigger wheel 7 is angled in the axial direction and partially encloses a lateral surface of camshaft adjuster 2.

Figure 1B:
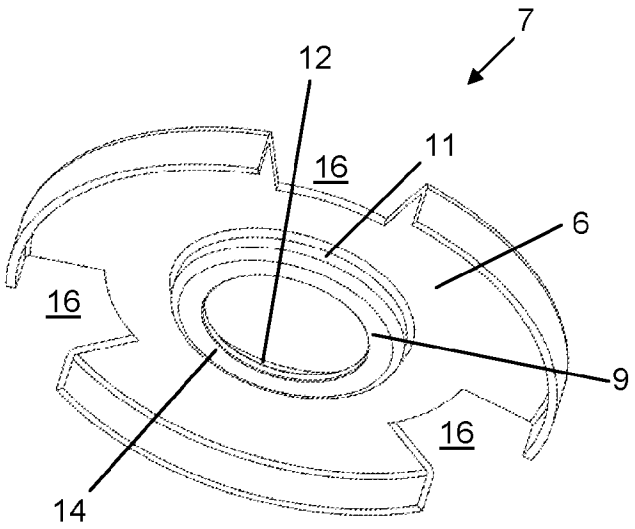
FIG. 1*b* shows the cover element designed as a trigger wheel according to FIG. 1*a*.

FIG. 1*b* shows cover element 6 designed as trigger wheel 7 according to FIG. 1*a*.

Trigger wheel 7 has a hub 9 which is interspersed with a circular bore. Hub 9 is followed by a centering section 11. Hub 9 forms a circular contact surface 14 on an axial front side for output element 5 and a circular contact surface 10 on the aforementioned axial front side opposite of the axial front side for camshaft 3. With the axial extension of centering section 11, a lateral surface 12 is formed which may cooperate with a complementary lateral surface of camshaft 3 or output element 5. Furthermore, trigger wheel 7 has three material recesses 16 distributed across its circumference.

Trigger wheel 7 may be provided entirely with friction-increasing means, such as a friction-increasing layer or a friction-increasing structure or a film element having a friction-increasing layer or structure. Alternatively, hub 9 only, or, in particular, contact surfaces 10 and/or 14 provided for the contact, may be provided with friction-increasing means such as a friction-increasing layer or a friction-increasing structure or a film element having a friction-increasing layer or structure. Optionally, the friction-increasing means, such as a friction-increasing layer or a friction-increasing structure or a film element having a friction-increasing layer or structure, may extend from hub 9 also to centering section 11 and include the same.

Figure 2A:
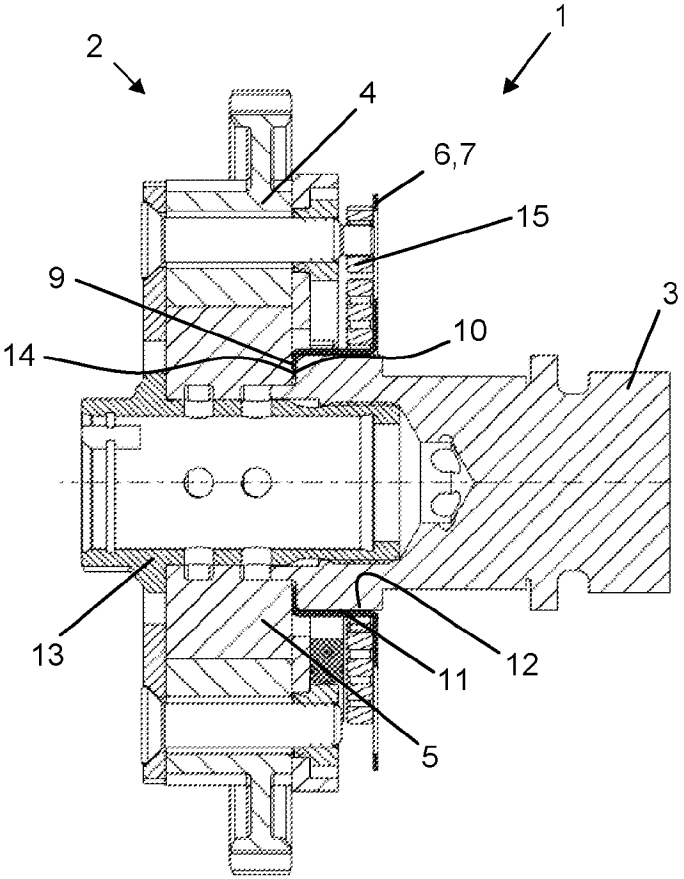
FIG. 2*a* shows a camshaft adjusting system having a camshaft adjuster and a camshaft and a cover element designed as a spring cover.

FIG. 2*a* shows a camshaft adjusting system 1 having a camshaft adjuster 2 and a camshaft 3 and a cover element 6 designed as a spring cover 8.

Camshaft adjuster 2 is mounted with the aid of a coaxially positioned central screw 13 to camshaft 3 and thus forms camshaft adjusting system 1. In particular output element 5, designed as a rotor, is rotatably fixedly connected to spring cover 8 and camshaft 3 by central screw 13. According to the present invention, spring cover 8 is clamped with its hub 9 between output element 5 and camshaft 3. In this configuration, the circular contact surface 10, which is formed on the side of hub 9 facing away from the rotor, makes contact with camshaft 3. The circular contact surface 14, which is situated on the side of hub 9 facing away from the camshaft, makes contact with output element 5. At least one of contact surfaces 10 or 14 is provided with friction-increasing means, such as a friction-increasing layer or a friction-increasing structure or a film element having a friction-increasing layer or structure. In this way, a higher torque may be transmitted in the screw connection, or the screw force for the transmission of the required torque may be reduced.

Spring 15, which braces driving element 4 to output element 5 in the circumferential direction, is situated on the side of camshaft adjuster 2 facing the camshaft and is covered by spring cover 8.

With its radial extension, spring cover 8 covers nearly the entire camshaft adjuster 2, in particular spring 15. Spring 15 is, as also in FIG. 1*a*, designed as a spring with radial coils and situated at the front side at camshaft adjuster 2. Moreover, spring 15 is positioned outside on camshaft adjuster 2, i.e., spring 15 is not completely encapsulated by a component, for example, driving element 4 or output element 5.

Spring cover 8 has a centering section 11 which sits or may sit on camshaft 3 with its lateral surface 12. Via this centering section 11, camshaft adjuster 2 may be centered with respect to camshaft 3, i.e., oriented coaxially toward one another.

Figure 2B:
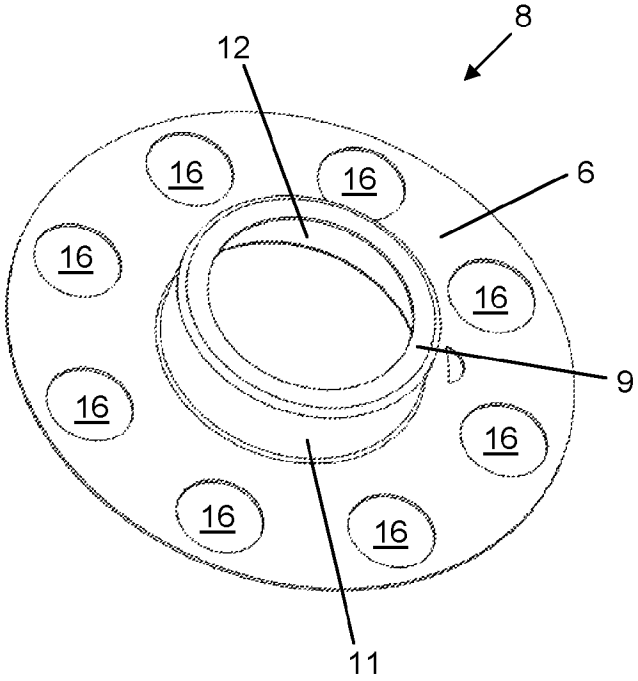
FIG. 2*b* shows the cover element designed as a spring cover according to FIG. 2*a*.

FIG. 2*b* shows cover element 6 designed as spring cover 8 according to FIG. 2*a*.

Spring cover 8 has a hub 9 which is interspersed with a circular bore. Hub 9 is followed by a centering section 11. Hub 9 forms a circular contact surface 14 on an axial front side for output element 5 and a circular contact surface 10 on the aforementioned axial front side opposite of the axial front side for camshaft 3. With the axial extension of centering section 11, a lateral surface 12 is formed which may cooperate with a complementary lateral surface of camshaft 3 or output element 5. Furthermore, spring cover 8 has multiple, in particular eight, material recesses 16 distributed across the circumference for weight decrease.

Spring cover 8 may be provided entirely with friction-increasing means, such as a friction-increasing layer or a friction-increasing structure or a film element having a friction-increasing layer or structure. Alternatively, hub 9 only, or, in particular, contact surfaces 10 and/or 14 provided for the contact, may be provided with friction-increasing means such as a friction-increasing layer or a friction-increasing structure or a film element having a friction-increasing layer or structure. Optionally, the friction-increasing means, such as a friction-increasing layer or a friction-increasing structure or a film element having a friction-increasing layer or structure, may extend from hub 9 also to centering section 11 and include the same.

LIST OF REFERENCE NUMERALS

1) camshaft adjusting system
2) camshaft adjuster
3) camshaft
4) driving element
5) output element
6) cover element
7) trigger wheel
8) spring cover
9) hub
10) contact surface
11) centering section
12) lateral surface
13) central screw
14) contact surface
15) spring
16) material recesses

What is claimed is:

1. A camshaft adjusting system comprising:

a camshaft adjuster;

a camshaft, the camshaft adjuster including a driving element and an output element situated so as to be pivotably movable with respect to the driving element, the output element being rotatably fixedly connected to the camshaft; and a cover element rotatably fixedly connected to the output element, the cover element having a hub situated between the output element and the camshaft, a radial direction of extension of the cover element being larger than a diameter of a contact surface of the hub to the camshaft.

2. The camshaft adjusting system as recited in claim 1 wherein the cover element is designed as a trigger wheel or as a spring cover.

3. The camshaft adjusting system as recited in claim 1 wherein the cover element covers a spring of the camshaft adjuster and is a trigger wheel.

4. The camshaft adjusting system as recited in claim 1 wherein the hub is provided with friction-increasing means.

5. The camshaft adjusting system as recited in claim 1 wherein the cover element is completely provided with a friction-increasing layer.

6. The camshaft adjusting system as recited in claim 1 further comprising a friction-increasing means, the friction-increasing means being a coating or a topographic structure of a surface of the cover element.

7. The camshaft adjusting system as recited in claim 1 wherein a contact surface of the cover element to the camshaft has a higher roughness than the rest of the cover element.

8. The camshaft adjusting system as recited in claim 1 wherein the hub (9) of the cover element is followed by a centering section centering the cover element with respect to the camshaft or to the output element.

9. A camshaft adjuster of a camshaft adjusting system, the camshaft adjuster comprising:

a driving element and an output element situated so as to be pivotably movable with respect to the driving element, the output element being rotatably fixedly connected to the camshaft; and a cover element rotatably fixedly connected to the output element, the cover element having a hub situated between the output element and the camshaft, a radial direction of extension of the cover element being larger than a diameter of a contact surface of the hub to the camshaft.

10. A cover element of a camshaft adjusting system having a driving element and an output element situated so as to be pivotably movable with respect to the driving element, the output element being rotatably fixedly connected to the camshaft, the cover element being rotatably fixedly connected to the output element and comprising:

a hub situated between the output element and the camshaft, a radial direction of extension of the cover element being larger than a diameter of a contact surface of the hub to the camshaft.

* * * * *